US007238089B2

(12) United States Patent
Tsumuraya et al.

(10) Patent No.: US 7,238,089 B2
(45) Date of Patent: Jul. 3, 2007

(54) POLISHING METHOD FOR INNER SURFACE OF TUBULAR BRITTLE MATERIAL AND TUBULAR BRITTLE MATERIAL OBTAINED BY POLISHING METHOD

(75) Inventors: Takeo Tsumuraya, Koriyama (JP); Masanori Suzuki, Koriyama (JP)

(73) Assignee: Heraeus Tenevo GmbH, Hanau (DE)

( * ) Notice: Subject to any disclaimer, the term of this patent is extended or adjusted under 35 U.S.C. 154(b) by 0 days.

(21) Appl. No.: 10/545,512

(22) PCT Filed: Feb. 11, 2004

(86) PCT No.: PCT/EP2004/001267

§ 371 (c)(1),
(2), (4) Date: Aug. 12, 2005

(87) PCT Pub. No.: WO2004/071709

PCT Pub. Date: Aug. 26, 2004

(65) Prior Publication Data

US 2006/0223427 A1 Oct. 5, 2006

(30) Foreign Application Priority Data

Feb. 12, 2003 (JP) ..... 2003-033802

(51) Int. Cl.
*B24B 5/40* (2006.01)

(52) U.S. Cl. ..... 451/61; 451/41; 451/57

(58) Field of Classification Search ..... 451/61, 451/27, 41, 51, 57, 464
See application file for complete search history.

(56) References Cited

U.S. PATENT DOCUMENTS

| | | | | |
|---|---|---|---|---|
| 5,305,556 | A | 4/1994 | Kopp et al. | |
| 5,643,069 | A * | 7/1997 | Christiansen et al. | 451/540 |
| 5,785,729 | A * | 7/1998 | Yokokawa et al. | 65/385 |
| 5,837,334 | A * | 11/1998 | Yokokawa et al. | 428/34.4 |
| 2002/0137447 | A1 | 9/2002 | Tiede | |

FOREIGN PATENT DOCUMENTS

| | | | | |
|---|---|---|---|---|
| EP | 1000908 | * | 5/2000 | 451/41 |
| JP | 2000-119034 | | 4/2000 | |

* cited by examiner

*Primary Examiner*—Robert A. Rose
(74) *Attorney, Agent, or Firm*—Tiajoloff and Kelly

(57) ABSTRACT

An object of the present invention is to provide a polishing method for producing, in a relatively short period of time, a tubular brittle material having an inner surface of high surface precision with a maximum roughness $R_{max}$ of 0.1 μm or smaller and a center line average roughness $R_a$ of 0.01 μm or smaller, and to provide a tubular brittle material with high precision using said polishing method. The polishing method according to the invention is characterized by that the inner surface of the tubular material being pre-cut into a tubular shape using a honing machine is further polished with a sheet material having diamond abrasives attached thereon. Also claimed is a tubular brittle material obtained by said polishing method.

10 Claims, 1 Drawing Sheet

POLISHING METHOD FOR INNER SURFACE OF TUBULAR BRITTLE MATERIAL AND TUBULAR BRITTLE MATERIAL OBTAINED BY POLISHING METHOD

INDUSTRIAL FIELD OF APPLICATION

The present invention relates to a polishing method for an inner surface of a tubular brittle material and the tubular brittle material to be obtained by the polishing method and, particularly, it relates to a method for polishing an inner surface of a quartz glass tube for use in production of an optical fiber with a good surface accuracy and the quartz glass tube having a high inner surface accuracy.

PRIOR ART

A tubular brittle material, particularly, a high-purity quartz glass tube has been used as a reaction tube of an inside vapor deposition method (MCVD method) for producing an optical fiber, or has been used as a jacket tube of a pre-preform produced by any one of the following methods: A Modified Chemical Vapor Deposition Method (MCVD method), an Axial Vapor Deposition Method (VAD method), and an Outside Vapor Deposition Method (OVD method). When irregularities or cracks are present on an inner surface of the high-purity quartz glass tube used as a jacket tube of a pre-preform, air bubbles are generated at the time the pre-preform and the quartz glass tube are melt-integrated with each other whereupon the thus-generated air bubbles cause problems of a wire breakage at the time of wire drawing, a contact defect of the optical fiber and the like. For these reasons, it is necessary to allow a surface accuracy of an inner surface of the quartz glass tube to be high. In JP-A No. 2000-119034 it is suggested to subject the inner peripheral surface of a high-purity quartz glass ingot to a mechanical grinding treatment by a diamond whetstone, and then the inner surface thereof is subjected to a mechanical polishing treatment by a whetstone made of cerium oxide.

PROBLEMS THAT THE INVENTION IS TO SOLVE

However, in a method described in the above-cited patent document, it occurs that a large fragment comes off an edge portion of a whetstone made of cerium oxide at the time of polishing and, the thus-generated fragment was seized in a space between the whetstone and a polished surface to cause a scratch on an inner surface of an article to be polished. Aiming at preventing generation of such scratch, a method in which abrasive grains made of cerium oxide are first dispersed in a grinding liquid and, then, a surface to be ground is subjected to grinding by a brush or the like has been developed. However, in this case the period of polishing time was extremely long so that the method was inferior in productivity. Further, another method has been developed in which a sheet of sheet material to which the abrasive grains made of cerium oxide were adhered (hereinafter referred to also as "cerium-oxide paper") is used. However, the cerium-oxide paper was low in an initial polishing ability, namely, the ability of grinding irregular portions by grinding at a preliminary step was low whereupon, not only it is necessary to allow roughness of the inner surface to be smaller at such preliminary polishing step, but also it is necessary to frequently change the cerium-oxide paper to a new one due to a heavy attrition; therefore, there was a problem of a high cost.

Therefore, it is an object of the present invention to provide a polishing method capable of performing polishing with a high surface accuracy without generating a scratch on an inner surface of a tubular brittle material.

Further, it is another object of the invention to provide a polishing method capable of reducing a polishing time.

Furthermore, it is still another object of the invention to provide a tubular brittle material having a high inner surface accuracy.

MEANS FOR SOLVING THE PROBLEMS

Under these circumstances, the present inventors have conducted an intensive study and, as a result, have found that, when the inner surface of the tubular brittle material which has been subjected to a preliminary grinding treatment using a honing machine is polished by using a sheet material on which diamond grains are attached (hereinafter also referred to as "diamond paper" or as "diamond sheet material"). The inner surface roughness obtained by using a "diamond paper" for the final polishing is the same as or even better than that which is obtained by performing polishing by using cerium oxide and, further, polishing time can substantially be reduced, thereby achieving the present invention.

Therefore, the present invention which attains the above-described objects relates to a method for polishing an inner surface of a tubular brittle material with a good surface accuracy which is characterized in that the inner surface of a brittle material which has been preliminarily ground into a tubular shape by a honing machine which is equipped with a polishing head and after that it is polished by a diamond sheet material. Furthermore the invention relates to a tubular brittle material having a high inner surface accuracy.

The term "brittle material" herein used is intended to include a material which has a small breaking strain when the material is allowed to be broken by an external force whereupon specific examples of such brittle materials include glass, and ceramics. In order to form a tubular body from the brittle material, a diamond whetstone is set on a honing machine and a grinding operation is started. As the grinding operation proceeds, diamond grains come off the whetstone and grains come off the article to be ground when it is ground adhere to a surface of the whetstone to cause clogging. When the clogging is generated, not only grinding ability is decreased, but also resistance between the whetstone and the article to be ground is changed whereupon a vibration is generated. In an extreme case, a large stress comes to be added to sometimes break the whetstone. This feature is conspicuous when polish-finishing is performed by using the whetstone having a smaller grain size. On the other hand, in a case in which sheet material adhered with diamond abrasive grains is used in place of the above-described diamond whetstone, it is found that, even when clogging is generated, since the sheet material itself has elasticity, no vibration is generated and, also, no breakage of sheet material is generated, thereby continuously performing a polishing treatment. It is also found that, when polishing is continuously performed in such a clogged state as described above, polishing proceeds more favorably than expected with a given gauge of the abrasive grains. It is considered that, when polishing of the brittle material is continuously performed while the diamond sheet material is clogged, an entire surface of the sheet material is covered by grains come off the article to be polished when it is polished and, since the grains are made of same material as that of the article to be polished, a so-called ground-in state is generated therebetween and, then, polishing grains themselves are ground to be gradually made smaller in size, thereby being capable of attaining a favorable polishing. When the diamond sheet material is used in such a manner as described above, since the tubular brittle material having a high surface accuracy can be obtained, a period of polishing time can substantially be reduced without necessity of changing diamond abrasive grains into those having a smaller gauge.

The base material of the "diamond sheet material" may be paper, textile or a plastic foil. The surface on which the diamonds are attached may be even, corrugated or it may show knobs.

Although a honing machine equipped with a polishing head is ordinarily used for polishing the tubular brittle material, it is difficult to expand the polishing head such that the polishing head is pressed against the entire inner surface of the brittle material whereupon the polishing head is partially expanded. Then, a whetstone is attached to the thus-expanded portion. When the tubular brittle material is polished by the honing machine attached with this polishing head, an edge portion of the whetstone is caught by a surface to be ground to sometimes generate a large fragment. The thus-generated fragment is seized between the edge portion of the whetstone and the surface to be ground to give a deep scratch on the surface to be ground. Therefore, it is preferred that the entire polishing head is covered with the diamond sheet material, even when an edge is present on the expanded portion, since the diamond sheet material is continuously provided, an intrusion of the fragment does not occur whereupon no scratch is generated on the inner surface of the brittle material.

A grain diameter of the diamond of the above-described diamond sheet material to be used is preferably in the range of from #500 to #10000 (the sign # represents the mesh size of the grains attached to the sheet material).

In a preferred embodiment of the method according the invention, the sheet material having diamond abrasives attached thereon is fixed to the polishing head by using a hook and loop fastener. The hook and loop fastener facilitates the replacement of used diamond coated sheets.

It has been found advantageous if the diamond abrasives are attached on a surface of the sheet material which is knobbed or corrugated. Such a surface is allows a flow of fluids, which are used as an auxiliary polishing agent for transporting and removal of the abraded glass particles.

MODE FOR CARRYING OUT THE INVENTION

The present invention will further be explained specifically with reference to embodiments to be described below, but is by no means limited to these embodiments.

A maximum roughness $R_{max}$ and a center line average roughness $R_a$ were measured on every 10 mm long in accordance with definitions set by Japanese Industrial Standards (JIS) B0601 whereby a contact-type simplified surface roughness meter was used for performing the measurement (Model: Surfcom 300B; manufactured by Tokyo Seimitsu Co., Ltd.).

EMBODIMENTS

Example 1

Figure 2:
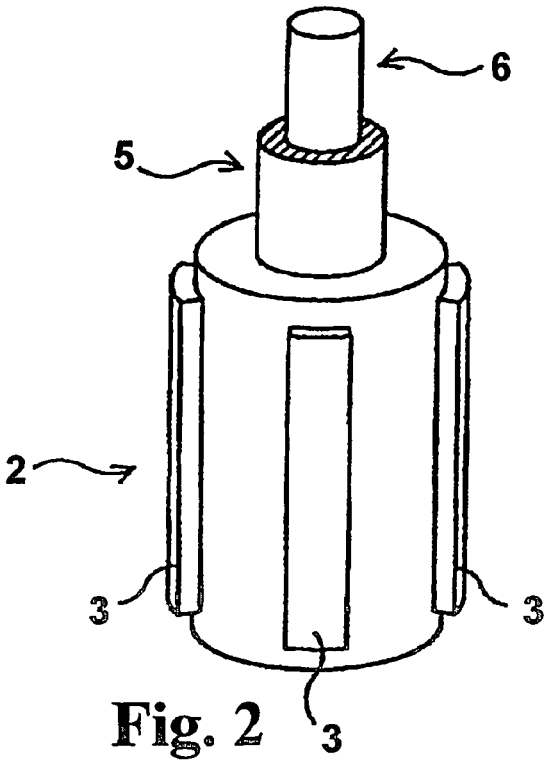
FIG. 2 is a schematically drawn diagram showing, a polishing head having an extended part in 4 directions.
Figure 3:
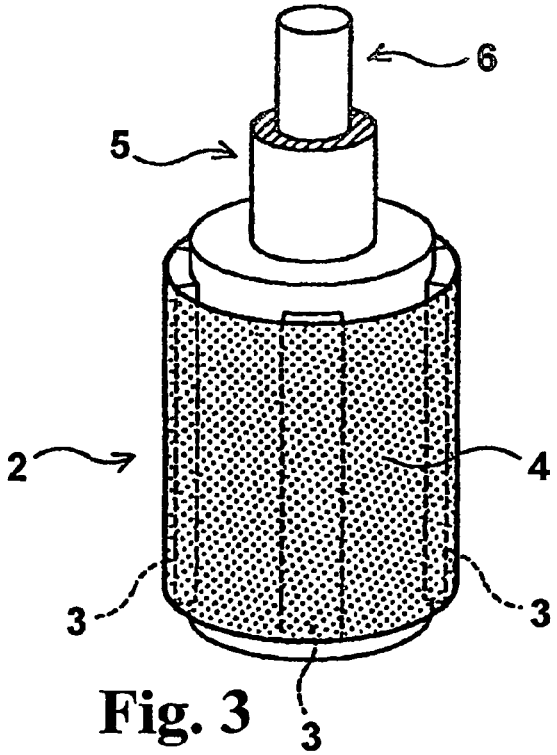
FIG. 3 is a schematically drawn diagram showing a polishing head having a diamond sheet material wound around the entire extended part.

Silicon tetrachloride was vaporized and, then, the thus-vaporized silicon tetrachloride was subjected to flame hydrolysis in an acid hydrogen flame and, thereafter, silica glass fine particles were allowed to be deposited on a surrounding area of a rotating substrate. A large-size porous soot body was obtained according to the OVD method. The thus-prepared porous soot body was put in an electric furnace and, while taking conditions such as a refractive index and the like of a core glass rod into consideration, dehydrated by heating at 1100° C. by a mixed gas of He and $Cl_2$ and, subsequently, allowed to be transformed into a transparent glass by heating at 1600° C. in an atmosphere of He to produce a cylindrical quartz glass ingot. Both ends of the thus-produced cylindrical quartz glass ingot were cut and, then, an inside thereof was ground by a vertical honing machine attached with a cylindrical polishing head as shown in FIG. 2 having expanded portions 3 (machine hones) which are distributed uniformly around the mantel surface and which extend along its entire length. The expanded portions 3 have a size of 25 cm long and 5 mm wide and they are set with a #800 resin-bonded diamond whetstone to prepare a quartz glass tube having an inside diameter of 50 mm and a length of 2 m. The entire polishing head including the expanded portions 3 was wrapped around by a diamond paper 4 and fixed thereon by a hook and loop fastener as it is shown in FIG. 3. The base material of the diamond paper 4 is a textile material having a corrugated surface on which diamond grains are attached. With reference to diamond grain diameters of the diamond paper 4 which was used for wrapping, #1200 was used at first, #2000 secondly and #3000 lastly by changing papers three times from one another.

Figure 1:
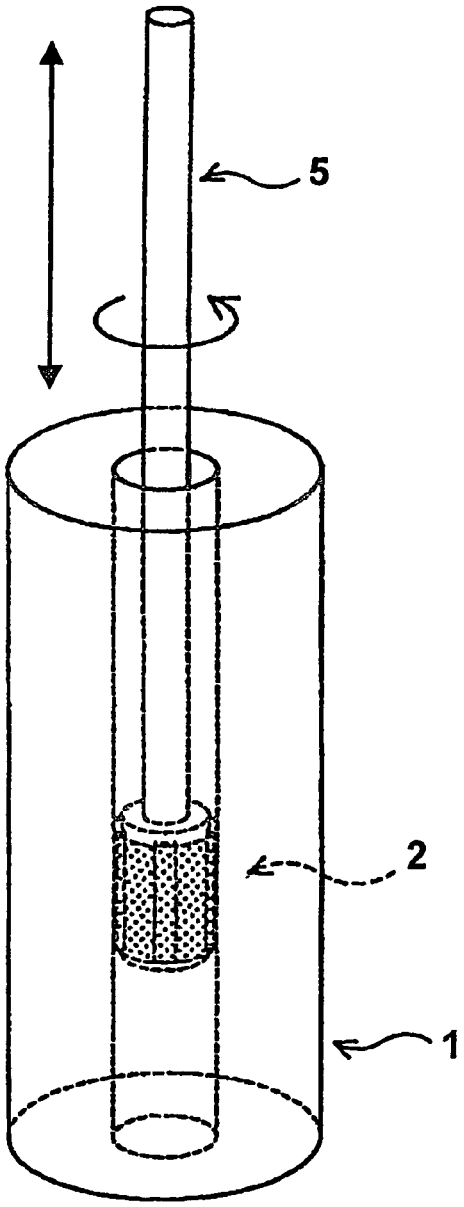
FIG. 1 is a schematically drawn diagram showing the polishing method according to the present invention.

The polishing head was inserted in the quartz glass tube and reciprocated 80 times along an entire length of the quarts glass tube while the polishing head was rotated at 100 rpm and moved at a speed of 3 m/min, as it is shown in FIG. 1. The maximum roughness $R_{max}$ and the center line average roughness $R_a$ of the inner surface of the thus-obtained quartz glass tube were 0.08 μm and 0.007 μm, respectively.

Time consumed for the polishing treatment was slightly less than 6 hours including time for change-over of diamond papers. When the diamond paper having grain size of #6000 was further reciprocated 80 times on the inner surface of the quartz glass tube, the maximum roughness $R_{max}$ and the center line average roughness $R_a$ of the inner surface of the quartz glass tube became 0.06 μm and 0.005 μm, respectively.

Example 2

Polish-finishing was performed in a same manner as in Example 1 except that the diamond paper 4 was attached only on the four expanded portions 3 (machine hones) which are distributed uniformly around the circumference of the polishing head 4. The maximum roughness $R_{max}$ and the center line average roughness $R_a$ of the inner surface of the obtained quartz glass tube were approximately same as those in Example 1; however, one helical scratch was observed which was conceivably caused by allowing a fragment of the whetstone or the quartz glass to be siezed was generated on the inner surface. Therefore, the result is acceptable only for low quality requirements and this is not the best mode for performing the method according to the invention.

Comparative Example 1

In order to perform polishing of the inner surface of the quartz glass tube having an inner diameter of 50 mm and a length of 2 m which has been obtained by grinding the quartz glass ingot having a same size as that in Example 1, a head of the honing machine attached with a nylon brush was set inside the quartz glass tube and, then, while a polishing liquid which has been obtained by mixing abrasive grains made of cerium oxide in pure water was flowed inside the tube from an upper portion thereof, the above-described brush was continuously reciprocated 240 times (80 reciprocations by three times) along an entire length of the quartz glass tube while the brush was rotated at 500 rpm and moved at a speed of 3 m/min. The maximum roughness $R_{max}$ and the center line average roughness $R_a$ of the inner surface of the obtained quartz glass tube were 0.5 μm and 0.2 μm, respectively. In order to allow the inner surface accuracy of the thus-obtained quartz glass tube to be same as that of the quartz glass tube in Example 1, it was necessary to consume slightly less than 22 hours in conducting 960 reciprocations.

Comparative Example 2

Same procedure was repeated as in Example 1 except that cerium-oxide paper was used in place of the diamond paper and one cycle of polishing in which the polishing head was reciprocated 80 times along an entire length of the quartz glass tube while the polishing head was rotated at 100 rpm and moved at a speed of 3 m/min was repeated three times while papers were changed each time. The maximum roughness $R_{max}$ and the center line average roughness $R_a$ of the inner surface of the obtained quartz glass tube were 0.35 μm and 0.15 μm, respectively. In order to obtain same inner surface as in Example 1 by this polishing method, it was necessary to repeat a cycle of 80 reciprocations 7 times while papers were changed each cycle. Time consumed for the polishing treatment was about 13 hours including time consumed for change-over of papers.

ADVANTAGE OF THE INVENTION

According to the polishing method of the present invention, a quartz glass tube having a high surface accuracy in which a maximum roughness $R_{max}$ and a center line average roughness $R_a$ of the inner surface thereof are 0.1 μm or less and 0.01 μm or less respectively can be produced in a relatively short period of time and, then, by using the thus-produced quartz glass tube as a jacket tube of a pre-preform or a reaction tube of an MCVD method, a high-quality optical fiber can easily be produced.

EXPLANATION OF SYMBOLS

1: Quartz glass tube
2: Polishing head
3: Extended part
4: Diamond paper
5: Shank bar
6: Pushing rod

The invention claimed is:

1. A method for polishing an inner surface of a tubular brittle material at high surface precision, said method comprising: subjecting the inner surface to a preliminary grinding treatment using a honing machine which is equipped with a polishing head, and after that polishing the inner surface with a sheet material having diamond abrasives attached thereon.

2. The polishing method as claimed in claim 1, wherein the sheet material having diamond abrasives attached thereon is wound around the polishing head of the honing machine.

3. The polishing method as claimed in claim 2, wherein the sheet material having diamond abrasives attached thereon is fixed to the polishing head by a hook and loop fastener.

4. The polishing method as claimed in claim 1, wherein the diamond abrasives have a grain diameter in the range of from #500 to #10000.

5. The polishing method as claimed in claim 1, wherein the diamond abrasives are attached on a surface of the sheet material which is knobbed or corrugated.

6. The polishing method as claimed in claim 2, wherein the diamond abrasives have a grain diameter in the range of from #500 to #10000.

7. The polishing method as claimed in claim 3, wherein the diamond abrasives have a grain diameter in the range of from #500 to #10000.

8. The polishing method as claimed in claim 2, wherein the diamond abrasives are attached on a surface of the sheet material which is knobbed or corrugated.

9. The polishing method as claimed in claim 3, wherein the diamond abrasives are attached on a surface of the sheet material which is knobbed or corrugated.

10. The polishing method as claimed in claim 4, wherein the diamond abrasives are attached on a surface of the sheet material which is knobbed or corrugated.

* * * * *

UNITED STATES PATENT AND TRADEMARK OFFICE

CERTIFICATE OF CORRECTION

PATENT NO. : 7,238,089 B2
APPLICATION NO. : 10/545,512
DATED : July 3, 2007
INVENTOR(S) : Takeo Tsumuraya et al.

It is certified that error appears in the above-identified patent and that said Letters Patent is hereby corrected as shown below:

In the patent frontispiece:

Title Page item 73 should read
Assignees: Heraeus Tenevo GmbH, Hanau (DE)
Shin-Etsu Quartz Products Co., Ltd., Tokyo (JP)

Signed and Sealed this

Twenty-sixth Day of February, 2008

JON W. DUDAS
*Director of the United States Patent and Trademark Office*